US009873139B2

(12) United States Patent
Dudley et al.

(10) Patent No.: US 9,873,139 B2
(45) Date of Patent: Jan. 23, 2018

(54) SYSTEM AND METHOD FOR AUTOMATICALLY CLEANING CONVERTERS

(71) Applicant: Ecochem Australia Pty Ltd, Upper Plenty VIC (AU)

(72) Inventors: Malcolm Robert Dudley, Wantirna South (AU); Geoffrey Grant Literski, Upper Plenty (AU)

(73) Assignee: Ecochem Australia Pty Ltd, Upper Plenty, VIC (AU)

( * ) Notice: Subject to any disclaimer, the term of this patent is extended or adjusted under 35 U.S.C. 154(b) by 84 days.

(21) Appl. No.: 14/662,525

(22) Filed: Mar. 19, 2015

(65) Prior Publication Data

US 2015/0190849 A1 Jul. 9, 2015

Related U.S. Application Data

(63) Continuation of application No. 14/170,639, filed on Feb. 2, 2014, now abandoned.

(60) Provisional application No. 61/760,653, filed on Feb. 5, 2013.

(51) Int. Cl.

| | |
|---|---|
| ***B08B 3/04*** | (2006.01) |
| ***B08B 3/08*** | (2006.01) |
| ***B41F 35/00*** | (2006.01) |
| ***B41F 35/04*** | (2006.01) |

(52) U.S. Cl.

CPC ..... *B08B 3/04* (2013.01); *B08B 3/08* (2013.01); *B41F 35/00* (2013.01); *B41F 35/04* (2013.01)

(58) Field of Classification Search

CPC .... B08B 3/04; B08B 3/08; B31B 1/88; B31B 2201/88; B41F 35/00; B41F 35/04

See application file for complete search history.

(56) References Cited

U.S. PATENT DOCUMENTS

| | | | | |
|---|---|---|---|---|
| 5,303,652 | A * | 4/1994 | Gasparrini | B41F 35/06 101/147 |
| 5,575,211 | A * | 11/1996 | Harrison | B41F 35/02 101/423 |
| 2004/0123758 | A1* | 7/2004 | Shields | B41F 31/08 101/350.5 |
| 2005/0058815 | A1* | 3/2005 | Chick | B41M 7/0081 428/195.1 |
| 2005/0250405 | A1* | 11/2005 | Howey | B08B 1/00 442/401 |

* cited by examiner

*Primary Examiner* — Saeed T Chaudhry
(74) *Attorney, Agent, or Firm* — Louis Ventre, Jr.

(57) ABSTRACT

A system and method is disclosed for cleaning an anilox roll and/or ink chamber of a converter. The system includes: a water supply (10*a*) adapted to supply water through an automatically controllable water supply valve (11*a*) to wash anilox roll and/or ink chamber; a cleaning solution supply (20*a*) adapted to supply a cleaning solution through an automatically controllable cleaning solution supply valve (21*a*) to clean the anilox roll and/or ink chamber; and a programmable controller (70) programmed to operate the automatically controllable valves (11*a*,21*a*) so as to deliver a timed sequence of water and cleaning solution to the cleaning part upon the occurrence of a cleaning cycle initiation condition.

16 Claims, 2 Drawing Sheets

SYSTEM AND METHOD FOR AUTOMATICALLY CLEANING CONVERTERS

CROSS-REFERENCE TO RELATED APPLICATIONS

This application is a continuation of U.S. patent application Ser. No. 14/170,639 filed 2 Feb. 2014, which claims the benefit of U.S. Provisional Application No. 61/760,653, filed 5 Feb. 2013, which are hereby incorporated by reference herein

TECHNICAL FIELD

In the field of industrial printing, a cleaning system and method is applicable to a converter useful in the corrugated box industry.

BACKGROUND

In the corrugated box industry, the "converters" that manufacture the boxes comprise as part of their function printing machines to print information on the box material before assembly of the box. There is currently a large amount of waste in time, ink materials and equipment degradation due to the difficulty of maintaining clean anilox rolls and ink chambers at the same time as keeping up the speed of production and hence minimizing the cost of production. Typically, converter ink cleaning systems are largely manual and use up substantial labor resources and machine downtime. Consequently, many converters operate in a fouled state and print quality diminishes. The inventors believe that in particular the cost associated with the negative effect on the lifetime of anilox rolls and ink chambers by inadequate cleaning has been underappreciated in the industry.

There is therefore a need to provide an improved system for cleaning converters.

SUMMARY OF THE INVENTION

According to a first broad aspect of the invention there is provided a system for cleaning an anilox roll and/or ink chamber of a converter, comprising: a water supply adapted to supply water through an automatically controllable water supply valve to wash the anilox roll and/or ink chamber of the converter; a cleaning solution supply adapted to supply a cleaning solution through an automatically controllable cleaning solution supply valve to clean the anilox roll and/or ink chamber; and a programmable controller programmed to operate the automatically controllable valves so as to deliver a timed sequence of water and cleaning solution to the anilox roll and/or ink chamber upon the occurrence of a cleaning cycle initiation condition.

In one embodiment, there is a plurality of the converters and corresponding automatically controllable valves, and the water supply and the cleaning solution supply for each of the converters originates from a common water supply source and cleaning solution supply source respectively. The cleaning solution supply source may comprise a container of cleaning solution concentrate, a dilution medium and a cleaning solution dilution apparatus adapted to supply the cleaning solution as a fixed or controllable ratio of the cleaning solution concentrate mixed with the dilution medium.

In one embodiment, the cleaning solution comprises a solvent to dissolve ink fouling the cleanable part, and a surfactant to reduce surface tension. The cleaning solution may further comprise a pH adjustment component. The cleaning solution may be selected and formulated so that the ink drops out of solution after the used cleaning solution is diluted into a waste water treatment plant, allowing the ink to be recovered before the waste water is discarded.

In one embodiment, the cleaning cycle initiation condition comprises a change of ink colour being used on the converter.

In one embodiment, the timed sequence of water and cleaning solution delivery comprises one or more subsequences of water and cleaning solution delivery followed by a final delivery of water to rinse out remaining cleaning solution from the converter.

In one embodiment, a water supply non-return valve is disposed downstream of the water supply valve.

In one embodiment, a cleaning solution supply non-return valve is disposed downstream of the cleaning solution supply valve. An outlet of the cleaning solution supply valve enters the water supply line downstream of the water supply non-return valve.

According to a second broad aspect of the invention there is provided a method of cleaning an anilox roll and/or ink chamber of a converter using the system of the first broad aspect, the method comprising the steps of: supplying water through the water supply; supplying cleaning solution through the cleaning solution supply; and activating the programmable controller to operate the automatically controllable valves so as to deliver a timed sequence of water and cleaning solution to the anilox roll and/or ink chamber upon the occurrence of the cleaning cycle initiation condition.

DETAILED DESCRIPTION OF EMBODIMENTS

Figure 1:
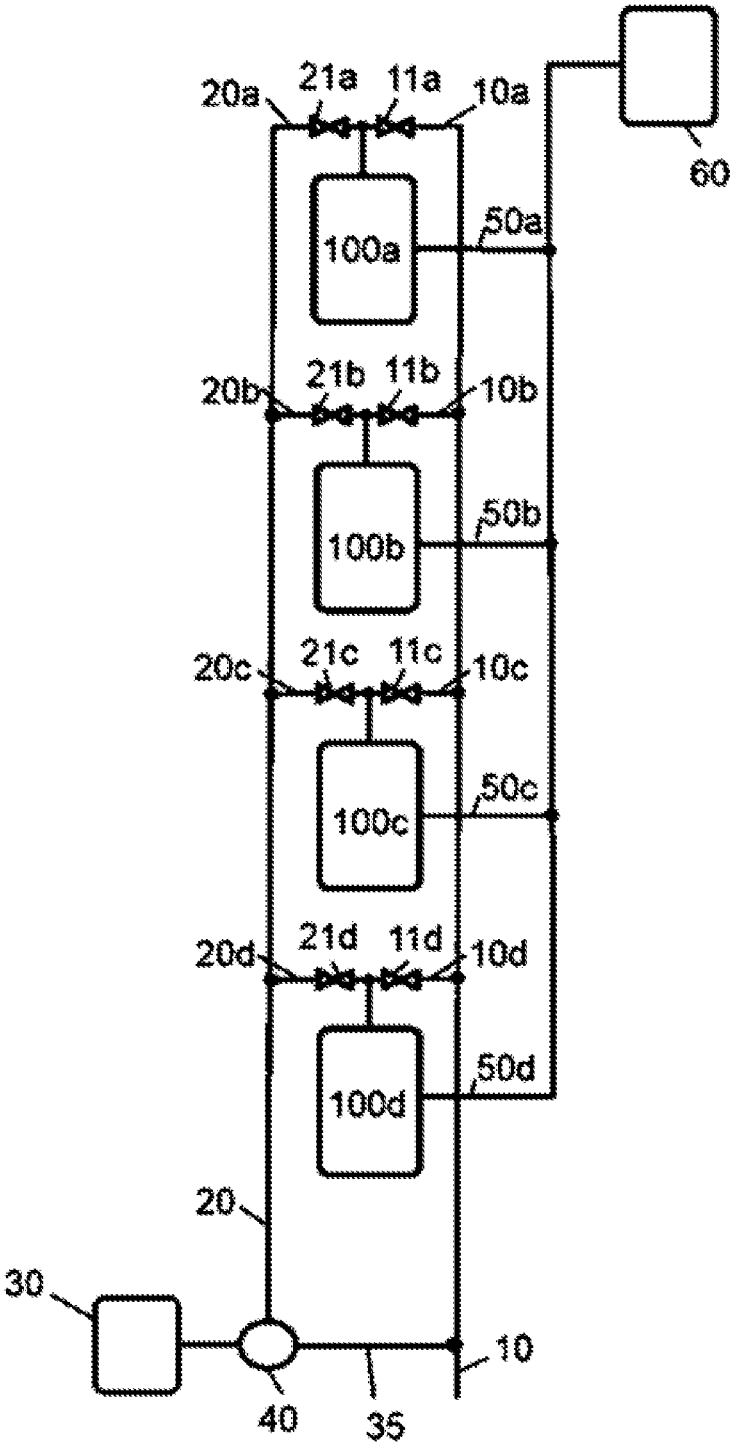
FIG. 1 is a functional block diagram of a printing premises comprising a plurality of converters fitted with the cleaning system of an embodiment of the invention.

An embodiment of the current invention will now be described, as applied to the fiberboard box business. Box forming premises contain "converters" providing forming, printing, cutting and folding functions for forming printed corrugated fiberboard boxes. Referring first to FIG. 1, converters 100*a* to 100*d* each have a water supply 10*a* to 10*d* respectively for supply of water for washing the anilox roll and/or ink chamber(s), the water supplies originating from a common water supply source 10 as is known in the art for converters which are manually cleanable.

According to this embodiment of the invention there is also provided, for each converter, a cleaning solution supply 20*a* to 20*d* respectively also originating from a common cleaning solution dilution supply source 20.

Cleaning solution is diluted using cleaning solution dilution apparatus 40 such as a Venturi mixing valve mixing a dilution medium 35 (in this case water) with a fixed or variable proportion of a cleaning solution concentrate from 264 gallon capacity container "tote" 30. In this case the recommended dilution ratio is 1:50. The cleaning solution concentrate held in container 30 contains several solvents to dissolve ink particles, surfactants to reduce surface tension on the cleanable part surfaces and hold the ink in solution, tripolyphosphate (TPP) and EDTA (ethylenediaminetetraacetic acid) to clean and chelate deactivating ions and monoethanolamine (MEA) to adjust the pH of the concentrate to about pH 10 and consequently the pH of the diluted cleaning solution to about pH 9, being a pH which is not too high to corrode parts, but sufficiently high so that the solvents and surfactants dissolve the ink particles.

As will be understood by person skilled in the art, the exact composition of the ingredients and the proportions in the cleaning solution concentrate will depend on the particular printing application and the characteristics of the machines and the printing inks involved. The cleaning solution of this embodiment is designed so that once diluted into the water dilution medium at a ratio of about 1:50, the cleaning solution effectively dissolves the waste ink and cleans the cleanable parts, and when the cleaning solution is further deleted by passage into a waste water treatment plant 60 via waste water drainage lines 50*a* to 50*d*, the dissolved ink falls out of solution, enabling recovery of the waste ink before discharge of waste from the premises.

Figure 2:
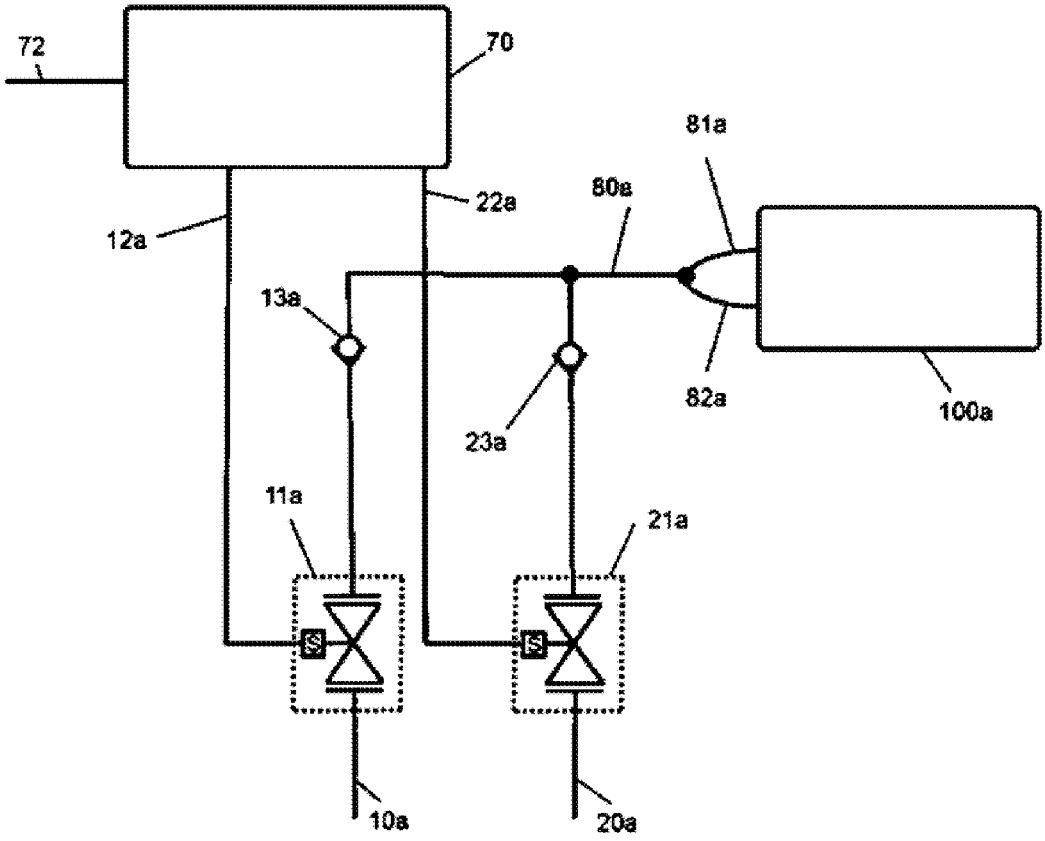
FIG. 2 is a functional block diagram of details of the control system of the embodiment of FIG. 1.

Referring now to FIG. 2, details of the system at one of the converters 100*a* are shown. Water supply 10*a* feeds into an input of solenoid-controlled water supply valve 11*a*, which is normally closed and switchable to an open position by energizing the solenoid through electrical control line 12*a* connected to an output of programmable logic controller 70. Similarly, cleaning solution supply 20*a* feeds into an input of solenoid-controlled cleaning solution supply valve 21*a* which is also normally closed and switchable to an open position by energizing its solenoid through electrical control line 22*a* connected to another output of programmable logic controller 70.

When programmable logic controller 70 energizes electrical control line 12*a*, water supply passes through the output of water supply control valve 11*a* and through nonreturn valve 13*a*, past the junction point meeting the output of cleaning solution supply valve 21*a* and into converter washing supply line 80*a*. Similarly, when programmable logic controller 70 energizes electrical control line 22*a*, cleaning solution passes through the output of cleaning solution supply control valve 21*a* past the junction point meeting the output of water supply control valve 11*a*, and into converter washing supply line 80*a*. Converter washing supply line 80*a* thus feeds ink chamber washing supply line 81*a* and spray bar washing supply line 82*a* either with nothing, with rinsing water or with cleaning solution depending on the energizing of the solenoids by programmable logic controller 70. Chamber washing supply line 81*a* feeds washing fluid to clean the ink chamber of the converter, and spray bar washing supply line 82*a* feeds washing fluid into the washing spray bar for washing the print roll.

In this embodiment, programmable logic controller 70 is programmed to energize the solenoids in a timed sequence so as to deliver a series of alternating water rinses and cleaning with cleaning solution. The cleaning cycle initiation condition that causes the timed sequence to commence is a change of ink color on the converter, sensed by programmable logic controller 70 through a control input 72 feeding an ink change signal from a factory control system or similar. The timed sequence comprises six subsequences each consisting of 14 seconds of water flow followed by 9 seconds of cleaning solution flow, followed at the completion of the six subsequences by 60 seconds of water flow as a final rinse.

The inclusion of nonreturn valves 13*a* and 23*a* on the water supply and the cleaning solution supply respectively, prevent the water supply from becoming contaminated with cleaning solution and vice versa. Also, the disposition of the outlet of the cleaning solution supply valve downstream from the water supply valve ensures that no cleaning solution is left in the system after the final water wash.

The system of the invention allows a time efficient and optimized cleaning strategy to be implemented that does not adversely impact on the daily output of the converter, but keeps the converter substantially free of ink residues and as hoped by the inventors has been found to considerably lengthen the service life of the anilox rolls as well as provide the expected overall improvement of the print condition of the formed and printed boxes.

In a typical installation, the cleaning cycle operates between one and 15 times per day.

Persons skilled in the art will also appreciate that many variations may be made to the invention without departing from the scope of the invention.

For example, while the example described utilizes a programmable logic controller 70 in relation to each converter, clearly a factory-wide control system could alternatively be used to control the automatically controllable valves.

Further, constructing systems according to the invention will usually involve attaching and augmenting solenoids, valves, supply lines and controllers to an existing factory system on the printing premises, and not necessarily replacing all existing components. For example, printing premises may already contain water supply lines to supply water to each converter for manual washing procedures and manual addition of cleaning solution.

Further, although the example described herein relates to fiberboard box converter businesses, the broadest aspect of the invention extends to systems for washing other types of converter.

Further still, the term "programmable controller" is used here in extends to any control system capable of being programmed to operate the automatically controllable valves, and includes programmable relay controllers, time clocks, computers and the like.

The timed sequence described in the embodiment above is an example only and can be varied depending on the installation.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention. Further, any method steps recited in the claims are not necessarily intended to be performed temporally in the sequence written, or to be performed without pause once started, unless the context requires it.

It is to be understood that, if any prior art publication is referred to herein, such reference does not constitute an admission that the publication forms a part of the common general knowledge in the art, in Australia or any other country.

What is claimed is:

1. A method of implementing a cleaning system in a converter, the method comprising the steps of:

altering the converter to add a cleaning device, the converter operable to form, print, cut and fold corrugated fiberboard boxes, the converter comprising an anilox roll that has been configured to transfer ink to be printed onto the corrugated fiberboard boxes;

the cleaning device comprising:

water;

cleaning solution;

a water supply supplying the water through an automatically controllable water supply valve and into a converter washing supply line to wash the anilox roll;

a cleaning solution supply supplying the cleaning solution through an automatically controllable cleaning solution supply valve and into the converter washing supply line to clean residues of the ink from the anilox roll; and a programmable controller programmed to operate the automatically controllable valves so as to deliver a timed sequence of the water and the cleaning solution to the anilox roll when a cleaning cycle is initiated; and configuring the cleaning device so that when the programmable controller opens the automatically controllable water supply control valve, the water flows past a junction point meeting an output of the automatically controllable cleaning solution supply valve and into the converter washing supply line, and when the programmable controller opens the automatically controllable cleaning solution supply control valve, the cleaning solution flows past the junction point and into the converter washing supply line.

2. The method of claim 1, further comprising the steps of:

providing a plurality of converters and corresponding automatically controllable valves; and providing a common water supply source;

providing a common cleaning solution supply source;

obtaining the water supply and the cleaning solution supply for each converter in the plurality of converters from the common water supply source and the cleaning solution supply source, respectively.

3. The method of claim 2, further comprising the step of making the cleaning solution from a composition of a solvent that dissolves ink fouling the anilox roll, and a surfactant that reduces surface tension.

4. The method of claim 2, further comprising the steps of:

providing a cleaning solution concentrate as a first component of the cleaning solution supply source;

providing a dilution medium as a second component of the cleaning solution supply source; and supplying the cleaning solution as a fixed or controllable ratio of the cleaning solution concentrate mixed with the dilution medium from the cleaning solution supply source.

5. The method of claim 4, further comprising the steps of:

including in the cleaning solution a solvent that to dissolves ink found on the anilox roll; and including in the cleaning solution a surfactant that reduces surface tension.

6. The method of claim 2, further comprising the step of initiating a cleaning cycle when there is a change of ink color to be used on the converter.

7. The method of claim 2, further comprising the steps of:

sequencing a timed delivery of the water and the cleaning solution; and rinsing the converter with water to flush out residual cleaning solution, said rinsing taking place after the timed delivery.

8. The method of claim 2, further comprising the step of positioning a water supply non-return valve downstream of the water supply valve.

9. The method of claim 1, further comprising the steps of:

including in the cleaning solution a solvent that to dissolves ink found on the anilox roll; and including in the cleaning solution a surfactant that reduces surface tension.

10. The method of claim 9, further comprising the step of including in the cleaning solution a component that changes the pH of the cleaning solution.

11. The method of claim 10, further comprising the steps of:

selecting and formulating the cleaning solution so that ink drops out of solution after a used cleaning solution is diluted into a waste water treatment plant, and recovering the ink before waste water is discarded.

12. The method of claim 9, further comprising the steps of:

selecting and formulating the cleaning solution so that ink drops out of solution after a used cleaning solution is diluted into a waste water treatment plant, and recovering the ink before waste water is discarded.

13. The method of claim 1, further comprising the step of initiating cleaning when there is a change of ink color to be used on the converter.

14. The method of claim 1, further comprising the steps of:

sequencing a timed delivery of the water and the cleaning solution; and rinsing the converter with water to flush out residual cleaning solution, said rinsing taking place after the timed delivery.

15. The method of claim 1, further comprising the step of providing a cleaning solution supply non-return valve downstream of the cleaning solution supply valve.

16. The method of claim 1, further comprising the step of providing a cleaning solution supply non-return valve downstream of the cleaning solution supply valve.

* * * * *